US006619704B1

(12) United States Patent
Lee

(10) Patent No.: US 6,619,704 B1
(45) Date of Patent: Sep. 16, 2003

(54) EMERGENT UNLATCHING MECHANISM FOR FIRE DOOR LATCH ASSEMBLY

(76) Inventor: Kun-Lin Lee, 10, 34$^{th}$ Road, Industrial Zone, Shitun District, Taichung (TW)

( * ) Notice: Subject to any disclaimer, the term of this patent is extended or adjusted under 35 U.S.C. 154(b) by 0 days.

(21) Appl. No.: 10/190,834

(22) Filed: Jul. 9, 2002

(51) Int. Cl.$^{7}$ ..... E05B 65/10

(52) U.S. Cl. ..... 292/93; 70/275; 292/21; 292/92; 292/DIG. 65

(58) Field of Search ..... 292/92, 93, 94, 292/21, 230, 231, DIG. 65; 70/275; E05B 65/10

(56) References Cited

U.S. PATENT DOCUMENTS 4,203,622 A * 5/1980 Cook et al. ..... 292/221
4,428,606 A * 1/1984 Proffer ..... 292/181
4,465,311 A * 8/1984 Austin ..... 292/144
4,540,208 A * 9/1985 Logan et al. ..... 292/341.19
4,709,950 A * 12/1987 Zortman ..... 292/92
4,747,629 A * 5/1988 Miller ..... 292/92
2002/0033606 A1 * 3/2002 Kimoto et al. ..... 292/144

FOREIGN PATENT DOCUMENTS

JP 5252799 * 4/1977
JP 52052798 * 4/1977

* cited by examiner

*Primary Examiner*—William L. Miller
*Assistant Examiner*—Carlos Lugo
(74) *Attorney, Agent, or Firm*—Rabin & Berdo, P.C.

(57) ABSTRACT

This assembly relates to an emergent unlatching mechanism for the fire door latch which includes a guide tube and a connecting tube so assembled and attached to the interior of the fire door latch without any necessary modification to the existing designed structure of the fire door. With no fire door key available, the fireman can use the ejection of water from the fire hydrant to open the fire door and enter the fire area for fire fighting.

4 Claims, 6 Drawing Sheets

EMERGENT UNLATCHING MECHANISM FOR FIRE DOOR LATCH ASSEMBLY

FIELD OF THE INVENTION

This invention relates to an emergent unlatching mechanism, simply attached to the interior of the fire door latch without any modification made to the designed structure of the fire door, the fireman uses the ejected water from the hydrant to open the fire door and enter the fire area in time for swift fire fighting.

BACKGROUND OF THE INVENTION

Generally, the fire door is formed to be filled with the fire insulation material in an effort to isolate the heat and thick smoke if there is a fire and to gain the first opportunity of escape. The fire door is an important part of the fire protection; it is designed for easy open to the escape and easy close for the fire separation. As shown in FIGS. 1 through 4, it is the latch member popularly employed on the fire door. It mainly comprises a latch assembly 20, a casing 21 in an inverted U form, a base plate 22 and a chamber to accommodate the latch tongue 24, arm 26 and swivel seat 28. A spring 25 with spring leg 251 is hung on an axle 23, which is fastened on the casing 21. The spring leg 251 of the spring 25 extends into a catch indent 241 at the lower end of the latch tongue 24 so as to keep the latch 24 always extend out of the casing 21 in up latch position. The latch tongue 24 has a presser 242 at it upper part. The arm 26 has a lug 261 in the center to be fixed with an axle 27 to the casing 21. The arm 26 has at the front end an upper arm 262 and the lower arm 263. The upper arm 262 supports the presser 242 of the latch tongue 24, and the lower arm 263 leans closely on a propeller 281 on the rotary seat 28. The arm 26 has a pressure wheel 264 at the rear end. The rotary seat 28 is fastened on the base plate 22 and has an inclined semicircular propeller 281. Now look at FIG. 4, When a downward vertical pressure is applied to the pressure wheel 264 of the arm 26, the arm produce a leverage along the axle 27, the lower arm 262 will push upward the presser 242 of the latch tongue 24, forcing the latch 24 turning along the axle 23 and entering the chamber of casing 22 to be in the down latch position. When the key blade 41 of the door key 40 is inserted the key grove 282 on the rotary seat 28, and is turned rightward so as to turn the propeller 281 of the rotary seat 28, which will displace the lower arm 263 and form an upward vertical pressure applied to the arm 26, so the upper arm 262 will push the presser 242 and eventually the latch tongue 24 moves inward in the chamber to be in the down latch position. As shown in FIG. 1, the base plate 22 of the latch assembly 20 is fixed on the surface of the fire door 10, and the pressing board 31 of the handle assembly 30 is also fastened to the surface of the fire door 10. The latch assembly 20 is disposed in the front end in which the pressure wheel 264 of the arm 26 in the latch assembly is situated to contact the pressure board 31 of the handle assembly 30. While the pressure board 31 of the handle assembly 30 is pressed downward, a downward vertical pressure is hereby applied to the pressure wheel 264 and consequently force the latch tongue to enter the chamber of the casing 21 and set in the down latch position, the fire door is allowed to open inward or outward. This action is similar to that of fire door key 40 as the key blade turns the rotary seat 28, pushing the lower arm 263 of the arm 26 upward, forcing the latch tongue 24 to enter the chamber of the casing 21 in the down latch position and release the fire door 10.

It is apparent that the latch assembly now used on the fire door 10 presents the fireman to enter the fire area behind the fire door 10 unless he has the fire door key in his hand. However, in most cases, the fire door key is stored under good custody, not always hanging on the fire door 10. If there is a fire, three is no way for the fireman to look for key first, the only compulsory tool he could employ is the torch cut to cut the fire door 10 open for fire fighting.

The inventor has deeply understood the setback the fireman faces to break through the fire door in the first place when a fire takes place and has devoted great efforts for years to the improvement of the latch assembly of the fire door and finally come up an emergent unlatching mechanism which can be easily opened with the water ejection from the fire hydrant and catch the first time to process the fire fighting.

SUMMARY OF THE INVENTION

The main object of the invention is provide an emergent unlatching mechanism to employed in the chamber of the latch assembly on the fire door. It consists of a guide tube with one end situated directly under the upper arm and other end linked to a connecting tube fastened on the fore door. While the high pressure fire fighting water enters the guide tube and the connecting tube as well, and push the upper arm upward which in turn forces the latch tongue entering the chamber of the casing to be in the down latch position, opening the fire door permits the fireman to rush into the fire area to process the fire fighting operation at fast step.

Another object of the invention is to provide an emergent unlatching mechanism for the fire door latch assembly in which the guide tube and the connecting tube have at least a bend for preventing the fire door form being opened by a slender round rod.

The technical features and performance are best explained by the aid of embodiment illustrated in the drawings.

DETAILED DESCRIPTION OF THE PREFERRED EMBODIMENT

Figure 1:
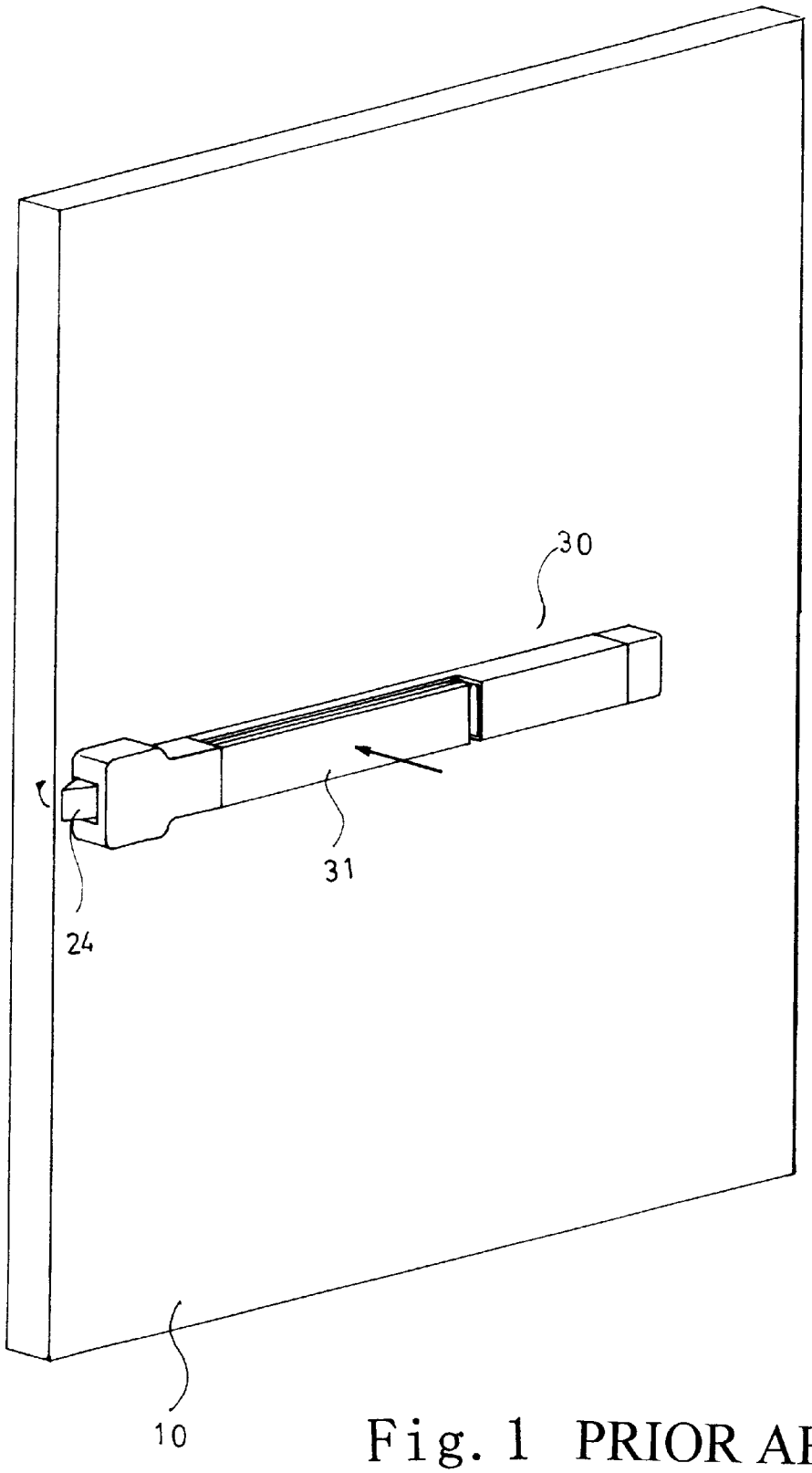
Fig. 1 PRIOR ART
FIG. 1 shows a general appearance of the fire door latch.
Figure 2:
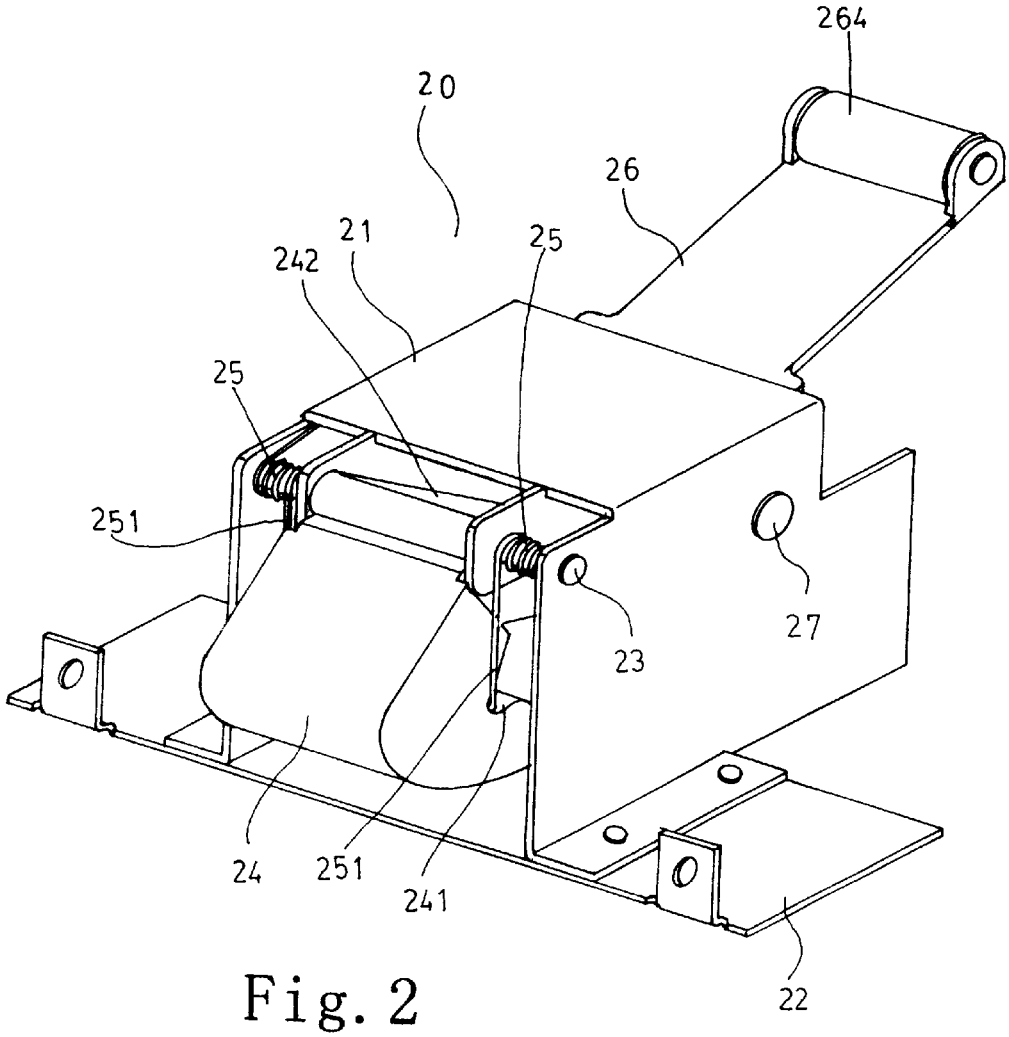
Fig. 2 PRIOR ART
FIG. 2 is a stereo diagram of latch assembly commonly used on the fire door latch.
Figure 3:
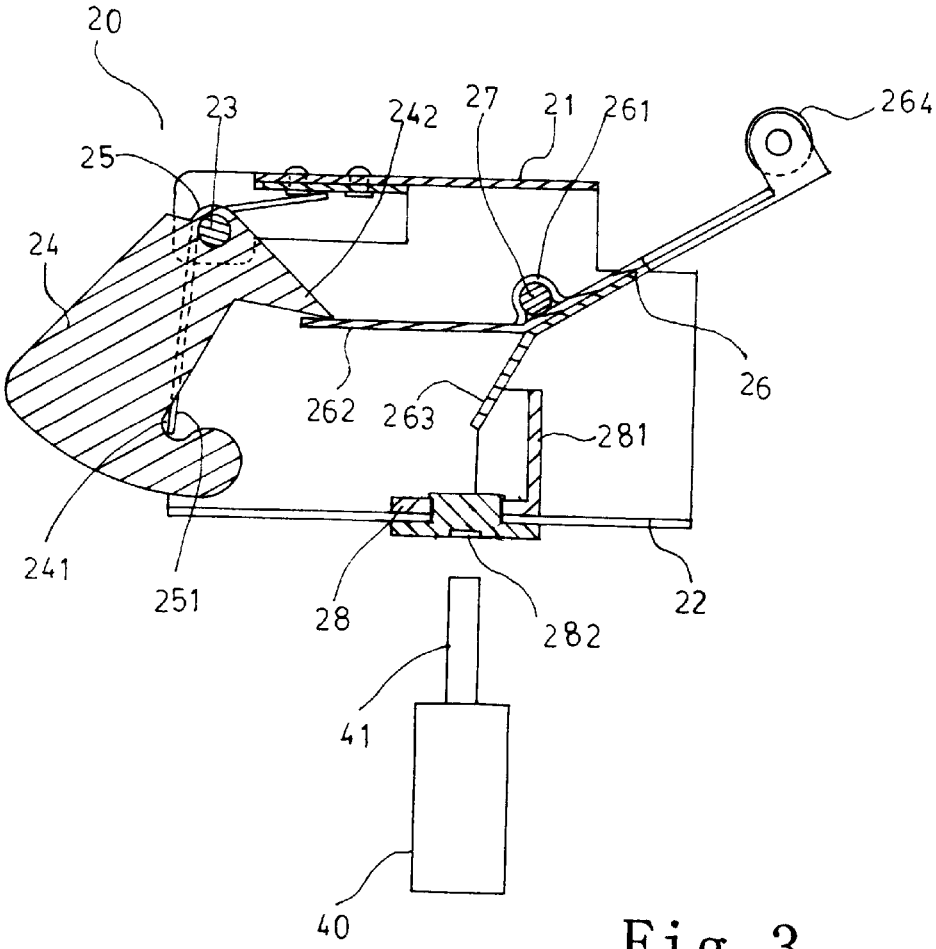
Fig. 3 PRIOR ART
FIG. 3 is a cross-section of latch assembly commonly used on the fire door latch.
Figure 4:
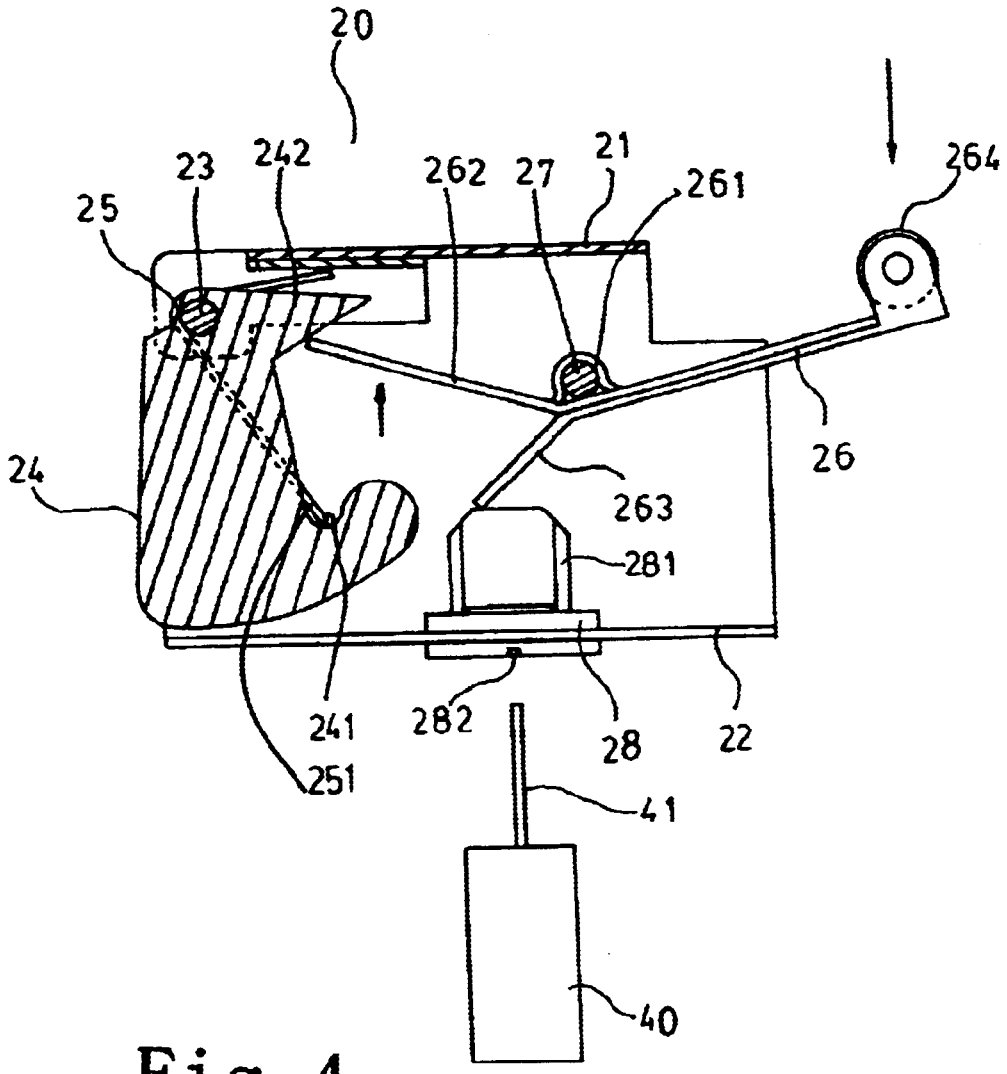
Fig. 4 PRIOR ART
FIG. 4 is operation of latch tongue in the latch assembly commonly used on the fire door latch.
Figure 5:
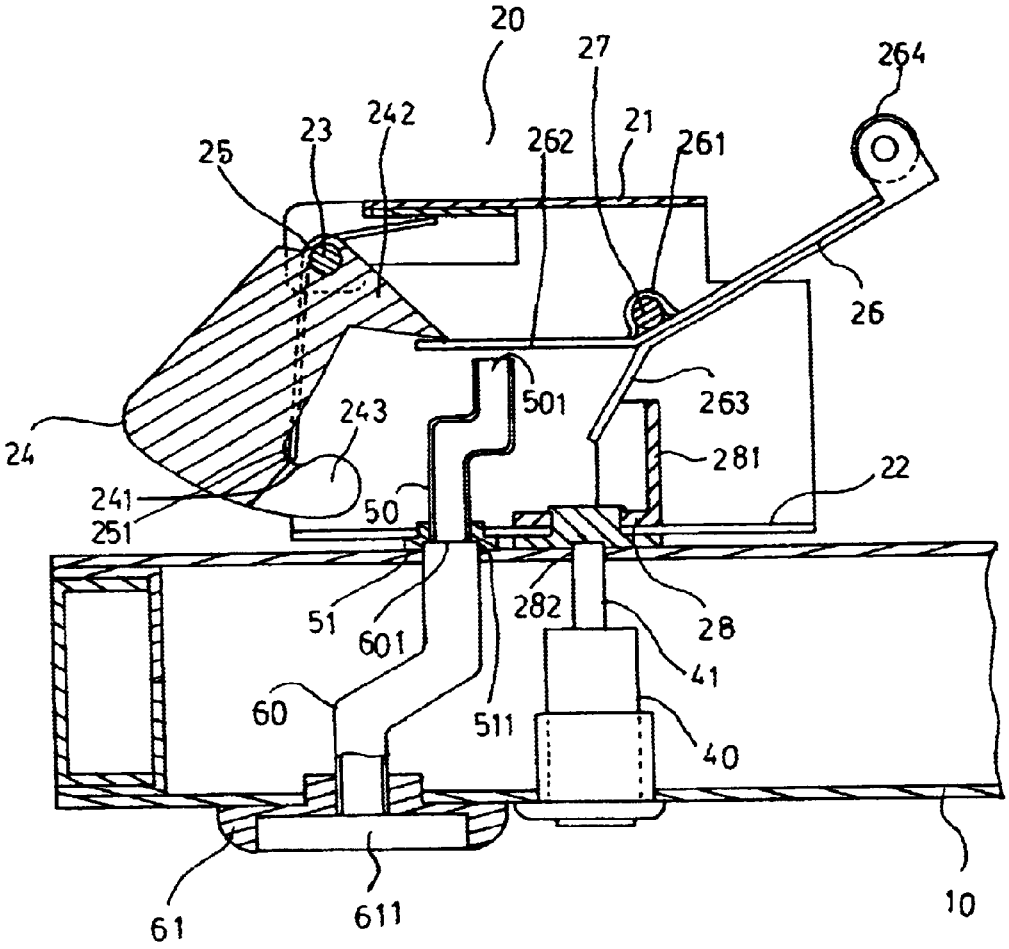
FIG. 5 is a cross-section showing the emergent unlatching mechanism installed in the latch assembly of the fire door.
Figure 6:
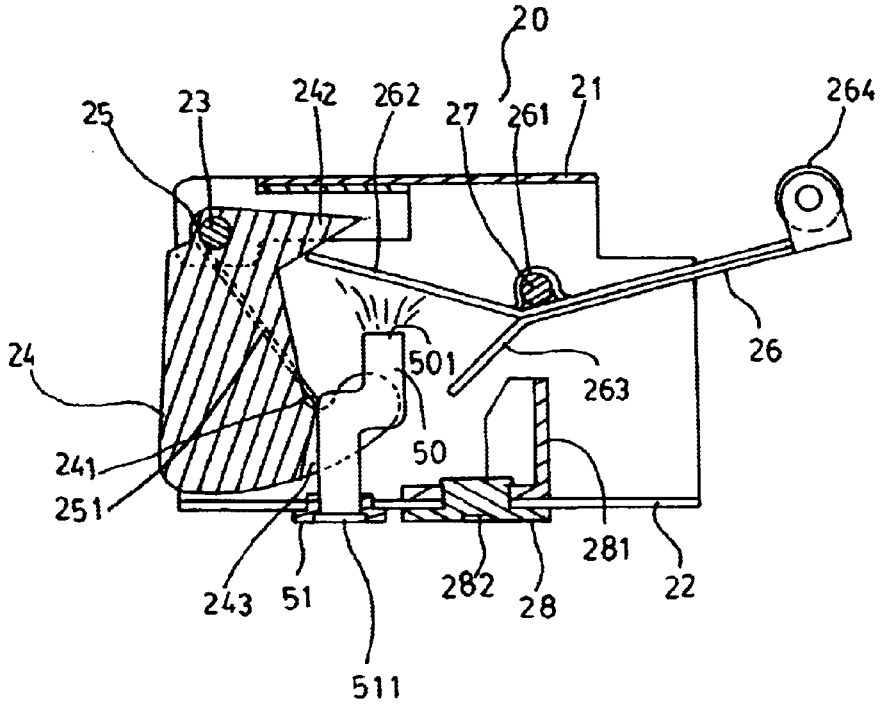
FIG. 6 is a cross-section showing the operation of the latch tongue in the latch assembly of the fire door.

As shown in FIGS. 5 and 6, the emergent unlatching mechanism of the invention is easily attached to the fire door latch assembly requiring no modification on the design structure of the fire door and can be easily opened by the fireman employing the high pressure water coming from the fire hydrant. The main composition is a guide tube 50 mounted on a seat 51 with a connecting opening 511 to receive the guide tube 50. The connecting opening 511 and the outlet 501 of the guide tube 50 is not in a line. The seat 51 is fastened on the base plate 22 of the latch assembly 20. A chamber is formed between the base plate 22 and the casing 21 to receive the guide tube 50. The outlet 501 of the guide tube 50 faces directly under the bottom of the upper arm 262 of the arm 26. The latch tongue has a cut 243 at the lower end, at the time when the latch tongue 24 retreats inward but never impairing the guide tube 50. A connecting tube 60 links with an intake 611 and an intake seat 61. The connecting tube 60 has a bend to keep the intake 611 out of direct line with the outlet 601. The intake seat 61 of the connecting tube 60 is installed on the surface of the fire door 10 permitting the intake 611 extended out of the surface of the fire door 10. Where the latch assembly 20 and the base plate 22 are mounted on the surface of the fire door 10, and the opening 511 of the guide tube 50 links with the outlet 601 of the connecting tube 60 as a complete emergent unlatching mechanism.

In operation, the fireman just plugs the nozzle of the water hose into the intake 611, and the high pressure water will flow through the connecting tube 60 and out of the outlet 501 of the guide tube 50 and directly lift the upper arm 262 of the arm 26, so the upper arm 262 moves the upper part of latch tongue 24 upward and the lower part retreat back into the chamber as shown in FIG. 6 to be in the down latch position. At the moment the fire door 10 is unlatched, the fireman can swift enter to fight the fire inside.

The important benefits of the emergent unlatching mechanism for the fire door latch of the invention are presented as follows:

1. In the contingency of fire, the fireman can employ the high-pressure water from the hydrant to open the fire door without resorting to the door key.

2. The emergent unlatching mechanism is simply and easily attached to the surface of the fire door without any modification.

3. The emergent unlatching mechanism presents any tamper with slim rod to open the fire door.

Many changes and modifications in the above-disclosed embodiment of the invention can, of course, be carried out without departing from the scope thereof. Accordingly, to promote the progress in science and the useful arts, the invention is disclosed and is intended to be limited only by the scope of the appended claims.

What is claimed is:

1. An emergent unlatching mechanism, mainly comprising a guide tube and a connecting tube simply and easily attached to a fire door latch, wherein:

said guide tube is mounted on a seat with an opening, said seat sits on a base plate of a latch assembly, a chamber formed between a casing and said base plate to receive said guide tube, an outlet of said guide tube facing directly toward a bottom of an upper arm, said connecting tube having one end linked to an intake seat and an intake, said intake seat mounted on a surface of a fire door, said connecting tube linking to interior of said fire door, said intake extending out of said fire door; and said latch assembly fastened on a surface of said fire door, said guide tube linking with said connecting tube permitting an emergent unlatch of said latch assembly by high-pressure water.

2. The emergent unlatching mechanism of claim 1, wherein said guide tube has bends so the opening and the outlet is not in a direct line.

3. The emergent unlatching mechanism of claim 1, wherein said connecting tube has bends and said intake and outlet are not in a direct line.

4. The emergent unlatching mechanism of claim 1, wherein said seat of the guide tube is fixed on said base plate of said latch assembly, a fixing place can be selected at option as long as an outlet of said guide tube is aligned with a bottom of an upper arm.

* * * * *